US006076937A

United States Patent [19]

Wood et al.

[11] Patent Number: 6,076,937

[45] Date of Patent: Jun. 20, 2000

[54] ILLUMINATED TOOL TRAY APPARATUS

[76] Inventors: Keith Bernard Wood, 71 Oakland St. Apt. 1, Mansfield, Mass. 02048; Kevin Alan Nordberg, 609 S. 19th St., Arlington, Va. 22202

[21] Appl. No.: 09/173,726

[22] Filed: Oct. 16, 1998

[51] Int. Cl.[7] ..... F21V 33/00

[52] U.S. Cl. ..... 362/154; 362/156; 362/231; 362/295

[58] Field of Search ..... 362/154, 156, 362/231, 295, 260

[56] References Cited

U.S. PATENT DOCUMENTS

| | | | |
|---|---|---|---|
| 3,231,730 | 1/1966 | Wagner | 362/154 |
| 4,761,720 | 8/1988 | Solow | 362/252 |
| 4,803,604 | 2/1989 | Nichols et al. | 362/154 |
| 5,219,446 | 6/1993 | Klepac | 362/154 |
| 5,337,225 | 8/1994 | Brookman | 362/145 |
| 5,344,339 | 9/1994 | Cheslock | 439/501 |
| 5,355,289 | 10/1994 | Krenn | 362/253 |
| 5,459,648 | 10/1995 | Courtney | 362/154 |
| 5,624,029 | 4/1997 | Shih | 206/372 |
| 5,685,421 | 11/1997 | Gilmore | 362/156 X |
| 5,741,061 | 4/1998 | Lehmann et al. | 362/154 |
| 5,769,533 | 6/1998 | Yamuro, et al. | 362/249 |
| 5,779,350 | 7/1998 | Chang | 362/154 |
| 5,803,586 | 9/1998 | Velez et al. | 362/154 |
| 5,879,071 | 3/1999 | Sanford, Jr. | 342/154 |
| 5,879,072 | 3/1999 | Huang | 362/156 |

OTHER PUBLICATIONS

Lineman's Utility Light, PLASTIC TECHNIQUES, INC., pp. 5–3 and 5–4, no date given.

Aerial Safety Light, PLASTIC TECHNIQUES, INC., pp. 5–1 and 5–2, no date given.

*Primary Examiner*—Stephen Husar

[57] ABSTRACT

An improved tool tray apparatus having an interior tool storage area, an upper peripheral edge portion, and a light emitting mechanism disposed around at-least a part of the upper peripheral edge portion. The light emitting mechanism improves the lighting conditions when working in poorly lighted environments. More particulary, the improved tool tray apparatus selectively illuminates the interior tool storage area of the tool tray, and the area around the upper peripheral edge portion of the tool tray to provide for a safer work environment. The light emitted by the illuminated tool tray apparatus of the invention may be controllably switched between different colors at a controllably varied intensity.

20 Claims, 5 Drawing Sheets

ILLUMINATED TOOL TRAY APPARATUS

BACKGROUND OF THE INVENTION

1. Field of the Invention

The present invention relates to an improved tool tray apparatus for use with a utility truck having an extendable arm with a bucket disposed at the end thereof. More particularly, the invention relates to a tool tray apparatus having an interior sidewall surface, and illumination means integral with the interior sidewall surface.

2. Discussion of the Background

Utility linemen are often called upon to work high above ground from a "bucket truck" type utility vehicle having a bucket disposed at the end of an extendable hydraulically driven arm. Many times, a utility lineman must perform various work duties high above ground at night time, under severe weather conditions, and/or in other poorly lighted hazardous environments. These severe weather conditions include thunder, lightening, rain, sleet, snow, heavy winds, etc. which at night time make for especially hazardous work environments. A need exists to provide a simple efficient means to improve lighting conditions within poorly lighted work environments to reduce the hazards of working under such conditions so that a utility lineman may work more safely, and efficiently perform various work duties.

Known tool tray apparatus designed for use by electrical utility linemen are made of a dielectric material, such as fiber glass, in order to reduce to possibility of providing a path to ground should the bucket be struck by lightning or make contact with any other high voltage source. They are generally box-shaped having an open top with tools lying loose on the bottom of the tray. Known tool trays are made in various sizes to accommodate different sizes and numbers of tools and can be made in various shapes to accommodate the curved sidewall shapes of various style buckets. For example, a small tray may have dimensions of approximately six inches wide, eighteen inches long, and eight inches deep. Larger trays can be made with dimensions as large as can be accommodated by the particular bucket with which they will be utilized. FIG. 1 illustrates a front view of a known prior art tool tray apparatus 10, with an attachment element 11, for securing the tool tray apparatus to the bucket of a bucket truck. FIG. 2 illustrates a top view of the known prior art tool tray apparatus of FIG. 1. FIG. 3 illustrates a rear view of the known tool tray apparatus of FIG. 1, with a spacer element 12, for stabilizing the tool tray apparatus against the side of the bucket. FIG. 4 illustrates a side view of the known tool tray apparatus of FIG. 1. FIG. 5 shows the extended hydraulic arm of a utility vehicle with a bucket indicating how a tool tray attaches to the bucket. The dotted cutout portion of FIG. 5 shows how the attachment element 11 hooks securely around the top edge of the bucket, and the spacer element 12 spaces the bottom the tool tray from the exterior side wall of the bucket to keep the tray vertical. The attached element is positioned using a bolt and nut arrangement with an adjustment slot so that the tray may be tightened against the bucket side wall.

The common practice of many utility lineman working with currently available tools, and techniques includes the practice of placing a flashlight within the interior tool storage area of the tray. This reduces the volume of the tray storage space available for other tools. Additionally, linemen sometimes wear a lighted miner type helmet. Such helmets can be blown or knocked off the linemen's head by wind, tree limbs, etc. Further, utility linemen often use brilliant ground lights, commonly referred to as phoenix lights, to illuminate the bucket and the work area surrounding the bucket from beneath. Battery powered aerial safety lights which can be hooked over the top of the bucket sidewall are also known.

A problem exists because any source of light which shines beneath an extended bucket with a tool tray apparatus disposed thereon forms shadows which can make seeing into the interior of the tool tray and the contents thereof difficult or impossible for a utility linemen working from within the bucket. A need exists to provide means to simply and efficiently illuminate the interior of the tool storage area of a tool tray and the work area surrounding the tool tray so as to eliminate visibility problems related to shadowing within the interior of the tool tray storage area and to additionally illuminate the area surrounding the tool tray apparatus.

SUMMARY OF THE INVENTION

According to this invention, there is provided an improved tool tray apparatus having illumination means integral therewith which may serve to variably illuminate the work area surrounding the tool tray, and the interior tool storage area of the tool tray to provide for the safest possible lighting conditions within the work environment of a utility linemen working from a bucket truck type utility vehicle. The tool tray provides for an integral light emitting mechanism disposed around the interior sidewall of the tool tray apparatus. The light emitting mechanism is preferably powered by a battery, rechargeable battery, and/or a power supply line.

The tool tray may additionally include a dimmer switch or the like to provide means to controllably vary the intensity of the light emitted by the light emitting element. Further, the tool tray may additionally include a switch mechanism to provide means for a lineman to controllably change the color of the light emitted by the light emitting element.

Accordingly, one object of this invention is to provide for a novel tool tray apparatus having illumination means integral therewith in order to provide means for illuminating the interior tool storage area of the tool tray apparatus, and the work area surrounding the tool tray apparatus.

It is an additional object of this invention to provide for an improved tool tray apparatus, as aforesaid, which may be alternatively powered by a battery power source, a rechargeable battery power source, and/or a power supply line.

It is a further object of this invention to provide an improved tool tray apparatus, as aforesaid, which can be used by electrical utility linemen or the like working from a bucket truck to improve lighting conditions in the work environment to enable utility linemen to perform various work duties under the safest possible lighting conditions.

It is still another object of this invention to provide for an improved tool tray apparatus, as aforesaid, which can be used by utility linemen or the like working from within a bucket truck in order to improve lighting conditions within the interior tool storage area of the tool tray by eliminating visibility problem associated with shadow effects caused by sources of light beneath the bucket to enable an utility linemen to perform various work duties under the safest possible lighting conditions.

BRIEF DESCRIPTION OF THE DRAWINGS

A more complete appreciation of the invention will be readily obtained as the same becomes better understood by reference to the following detailed description when considered in connection with the accompanying drawings, wherein.

DESCRIPTION OF THE PREFERRED EMBODIMENTS

Figure 1:
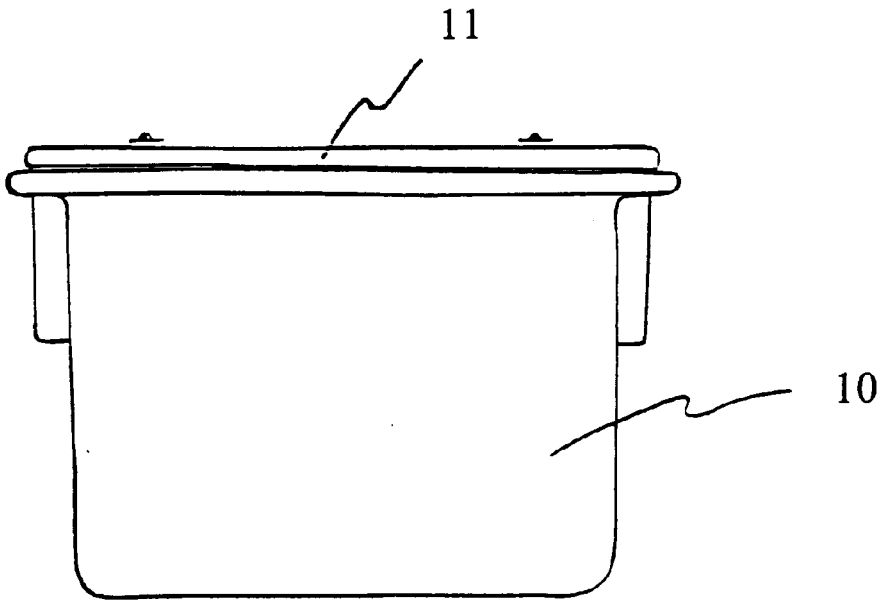
FIGURE 1 (Prior Art)
FIG. 1 is a front view of a known prior art tool tray apparatus.
Figure 2:
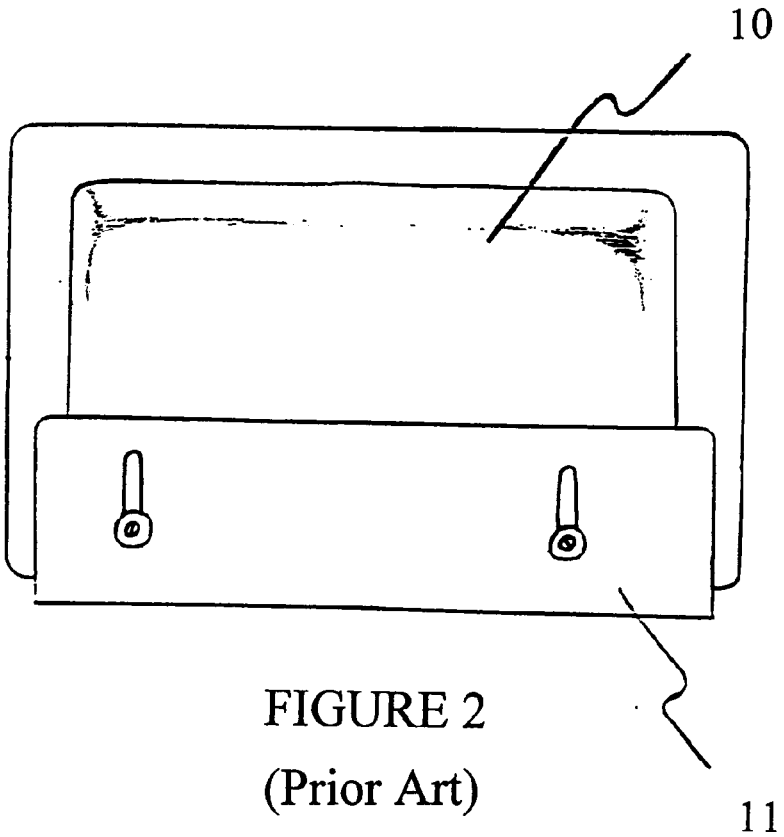
FIGURE 2 (Prior Art)
FIG. 2 is a top view of a known prior art tool tray apparatus.
Figure 3:
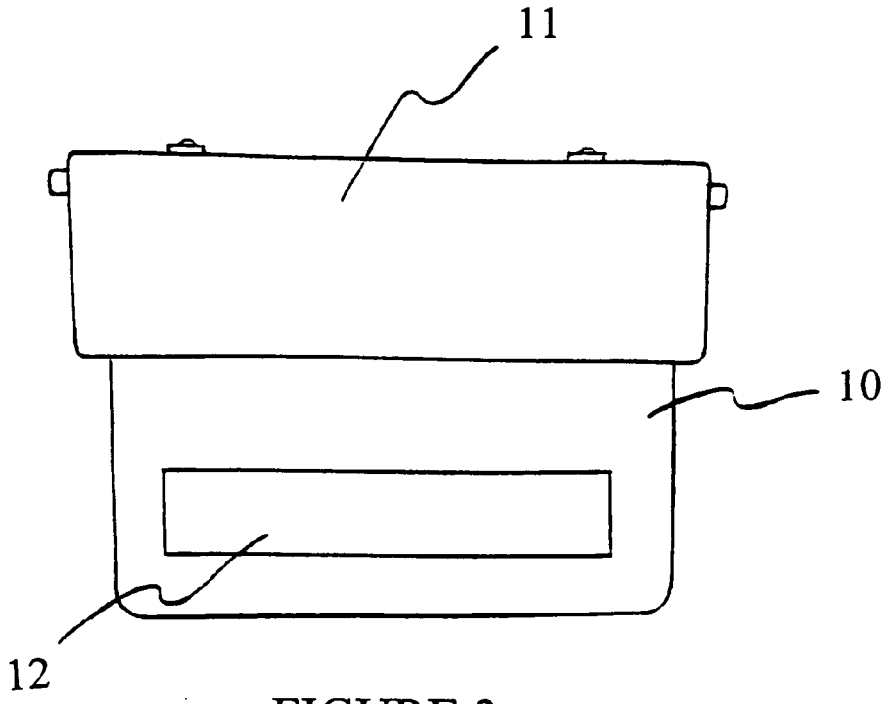
FIGURE 3 (Prior Art)
FIG. 3 is a rear view of a known prior art tool tray apparatus.
Figure 4:
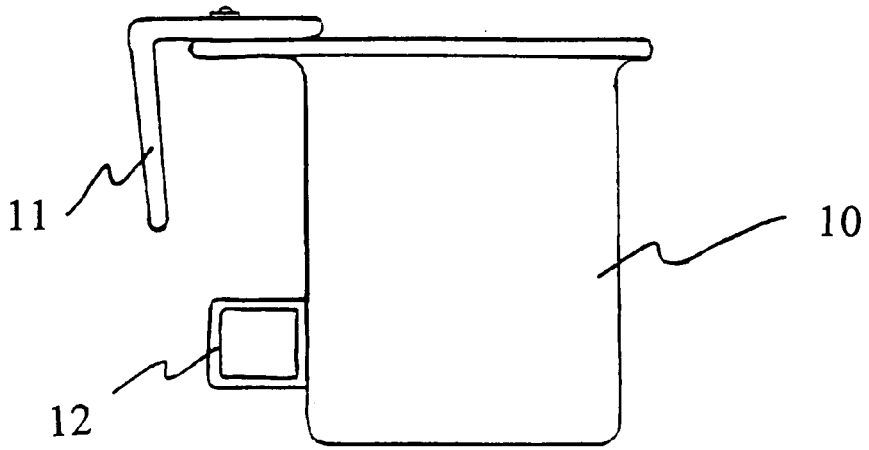
FIGURE 4 (Prior Art)
FIG. 4 is a side view of a known prior art tool tray apparatus.
Figure 5:
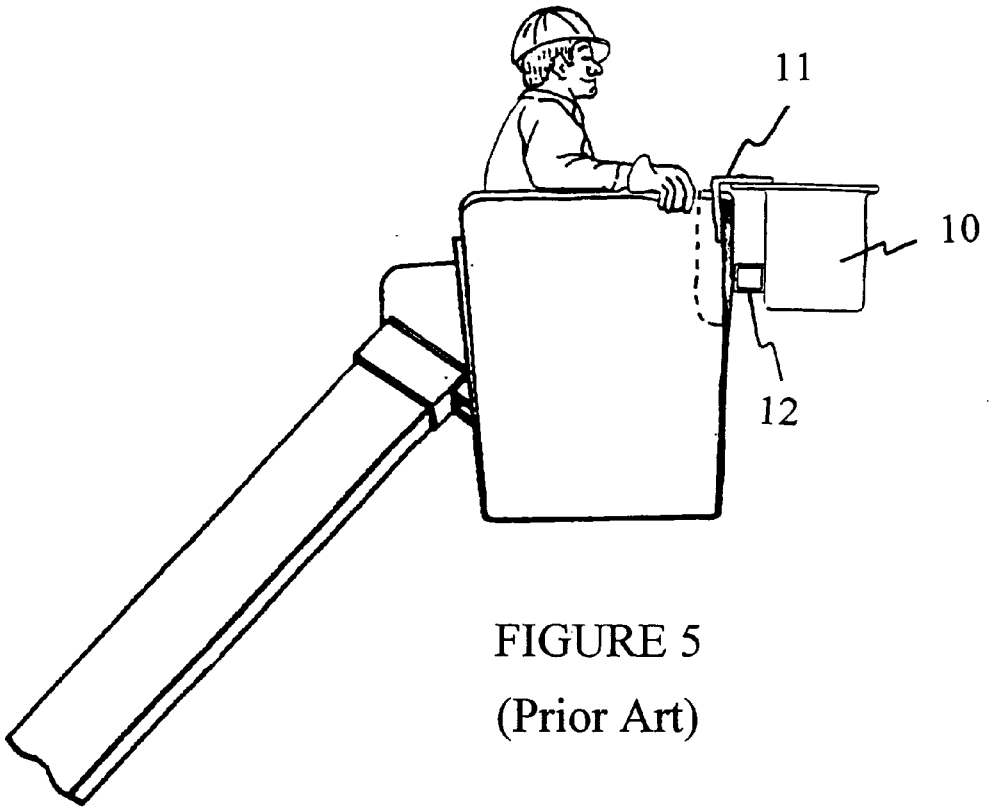
FIGURE 5 (Prior Art)
FIG. 5 is a side view of a known prior art tool tray apparatus attached to a bucket.
Figure 6:
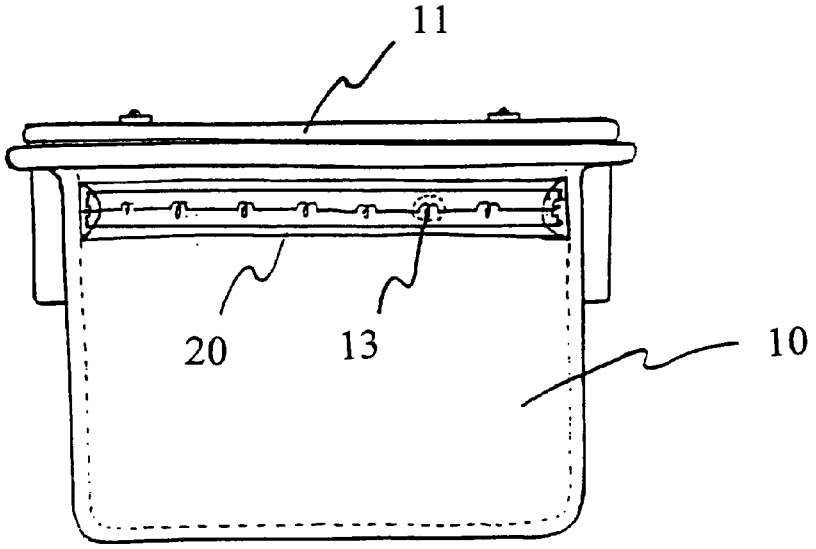
FIG. 6 is a front view of a preferred embodiment of the improved tool tray apparatus according to the invention.

Referring now to the drawings, wherein like reference numerals designate identical or corresponding parts throughout the several views, FIG. 6 illustrates a front view of a preferred embodiment of the tool tray apparatus of the subject invention including a cut away portion to show a light emitting mechanism 20, disposed around the inside surface of the tipper peripheral edge portion of the side wall of the tool tray apparatus. The light emitting mechanism 20 may be mounted around any portion of the interior sidewall surface of the tool tray to illuminate the interior of the tool tray and eliminate problems related to shadowing. It is preferred to dispose the light emitting mechanism on the upper peripheral edge portion of the interior sidewall surface of the tool tray to maximize the ability to illuminate the work area surrounding the tool tray.

Figure 7:
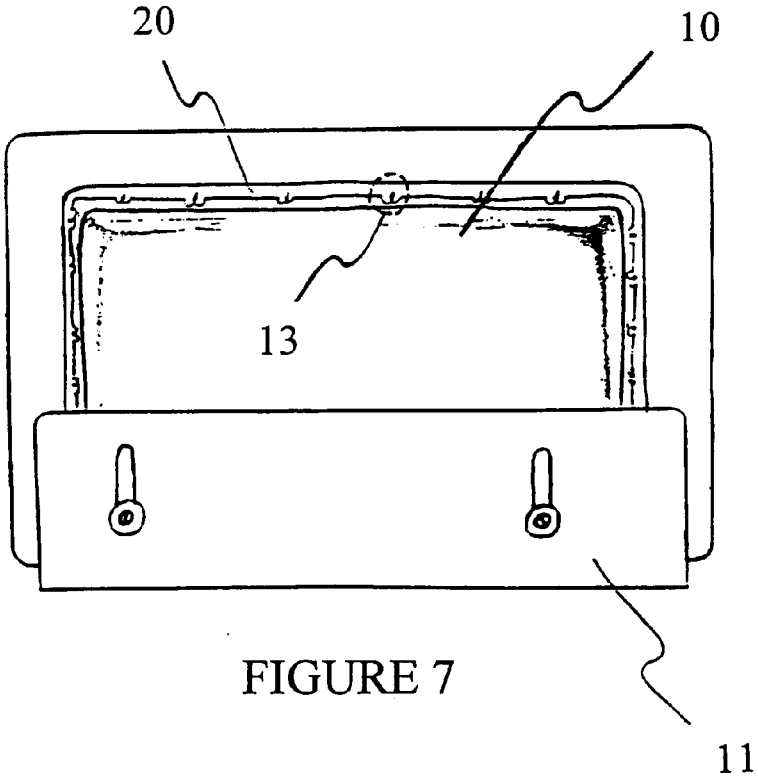
FIG. 7 is a top view of a preferred embodiment of the improved tool tray apparatus according to the invention.

FIG. 7 illustrates a top view of the preferred embodiment of the tool tray apparatus of FIG. 6 including the light emitting mechanism 20, disposed around the inside surface of the upper peripheral edge portion of the interior sidewall of the tool tray apparatus.

Figure 8:
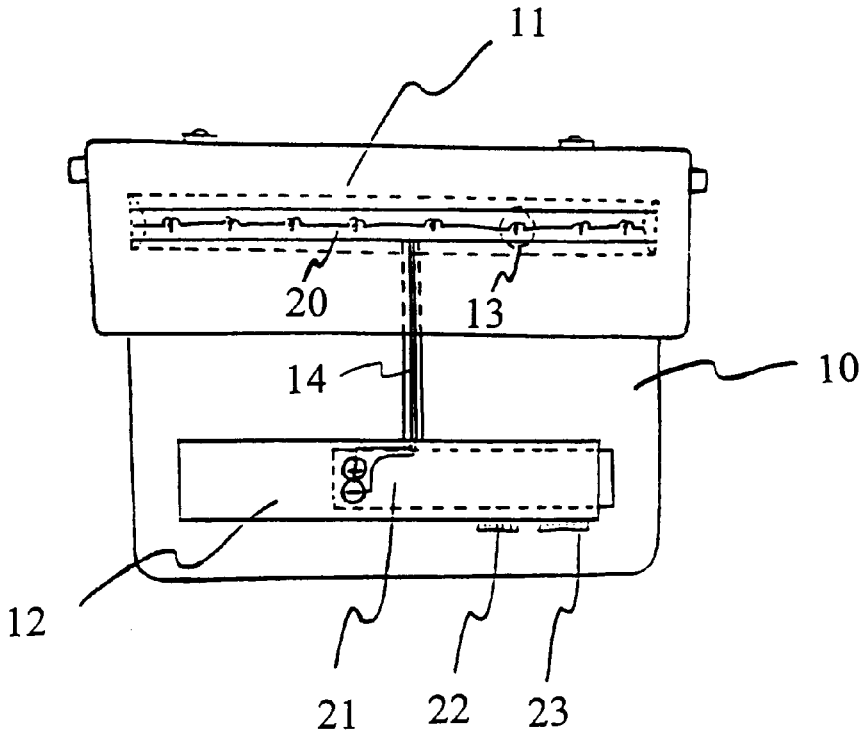
FIG. 8 is a rear view of a preferred embodiment of the improved tool tray apparatus according to the invention.

FIG. 8 illustrates a rear view of the preferred embodiment of the tool tray apparatus of FIG. 6, including cut away portions to show a battery type power supply 21, and a wire 14 electrically connecting the battery power supply 21 to the light emitting mechanism 20. FIG. 8 additionally illustrates a switch element 22 for selectively controlling the color of light emitted by light emitting mechanism 20, and switch element 23 for selectively controlling the amount of light emitted by light emitting mechanism 20.

Figure 9:
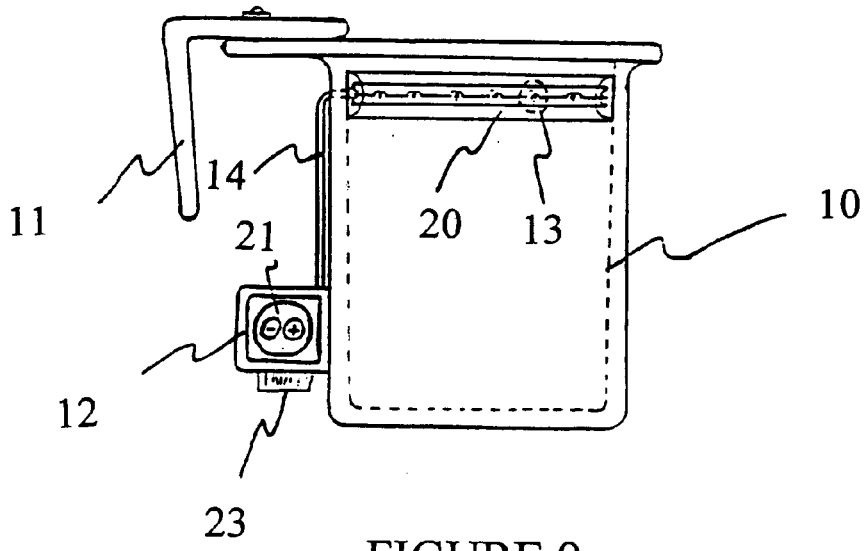
FIG. 9 is a side view of a preferred embodiment of the improved tool tray apparatus according to the invention.

FIG. 9 illustrates a side view of the preferred embodiment of the tool tray apparatus of FIG. 6, including a battery power supply 21, a wire 14 electrically connecting the battery power supply 21 to the light emitting mechanism 20 revealed by a cut away portion, and switch element 23 for selectively controlling the amount of light emitted by light emitting mechanism 20.

A preferred embodiment of the tool tray utilizes a light emitting mechanism 20 made of a strip of light disbursing polymer material having a plurality of individual light emitting elements 13 embedded therein. This light source provides for a tough, flexible, impact resistant light emitting mechanism which may be simply and easily adhered to the interior sidewall surface of known tool tray apparatus. Obviously, the light emitting mechanism 20 of the tool tray apparatus of the subject invention may comprise many other suitable light emitting mechanisms, including but not limited to, an incandescent type light emitting mechanism, a flourescent type light emitting mechanism, etc.

Referring to FIG. 6, the tool tray preferably utilizes a light emitting mechanism 20, comprised of a strip of flexible polymer material having a plurality of individual light emitting elements 13, wherein the light emitting mechanism 20 can selectively emit white colored light, amber colored light, such as that emitted by known fog lights, and both white and amber colored light by including individual light emitting elements 13 which emit either white or amber colored light. Switch element 22 provides utility linemen with means to selectively power either the white colored light emitting elements, the amber colored light emitting elements, or both the white and amber colored light emitting elements. A utility lineman can therefor control the color of light emitted by the light emitting mechanism to enhance visibility under certain environmental conditions, such as certain weather conditions which favor the emission of a particular color of light. For example, amber colored light emission reduces visibility problems caused by the reflection of white light when working in fog or snow. Further, both white and amber colored light emission would be favored when working under extremely dark conditions where the emission of a maximum amount of light would provide for the safest possible work environment. The switch element 22 may comprise a conventional toggle type switch or any other suitable switching mechanism.

The light emitting mechanism may have a single strip of light disbursing polymer material wherein both white light emitting elements, and amber color light emitting elements are embedded therein, and wired to provide for the selective emission of different colored lights, as described above. Alternatively, the light emitting mechanism may have two light emitting strips of a light disbursing polymer material, wherein one strip emits white colored light, and the other strip emits amber colored light, and wherein the strips are wired to provide means to selectively control the emission of different colored lights, as described above.

The tool tray utilizes a power supply 21, comprising a rechargeable battery pack sized to fit within the generally square cross-sectional spacer piece 12, disposed on the rear side surface of known prior art fiberglass tool trays. In a preferred embodiment of the tool tray specifically designed for use by utility linemen, only a battery type power supply may be used because of the potentially dangerous path to ground that a conductive power cord or the like could provide should the bucket be struck by lighting, or make contact with any other high voltage source.

In a preferred embodiment of the tool tray, the spacer piece 12, additionally houses switch elements 22, and 23 which provide means to selectively emit different colors of light and a variable amount of light, as noted above.

Many additional modifications and variations of the tool tray apparatus of the present invention are possible in light of the above teachings. The battery power supply, the switch and dimmer mechanisms may be mounted in various positions to accommodate various sizes, shapes and styles of utility buckets. It is therefore to be understood that within the scope of the appended claims, the invention may be practiced otherwise than as specifically described herein.

What is claimed as new and is desired to be secured by Letters Patent of the United States is:

1. An illuminated tool tray apparatus comprising:

a tool tray having an interior sidewall surface with an upper peripheral edge portion and an interior tool storage area;

a power supply; and illumination means connected to said power supply and disposed on at least a part of said sidewall surface, wherein said illumination means emits light to illuminate said interior tool storage area and an area surrounding said tool tray.

2. An illuminated tool tray apparatus according to claim 1, wherein said illumination means is disposed around said upper peripheral edge portion of said interior sidewall surface.

3. An illuminated tool tray apparatus according to claim 1, wherein said illumination means comprises at least one strip of light disbursing polymer material having at least one light emitting element embedded therein.

4. An illuminated tool tray apparatus according to claim 2, wherein said illumination means comprises at least one strip of light disbursing polymer material having at-least one light emitting element embedded therein.

5. An illuminated tool tray apparatus according to claim 1, wherein said illumination means comprises at least one incandescent light emitting element.

6. An illuminated tool tray apparatus according to claim 2, wherein said illumination means comprises at least one incandescent light emitting element.

7. An illuminated tool tray apparatus according to claim 1, wherein said illumination means comprises at least one flourescent light emitting element.

8. An illuminated tool tray apparatus according to claim 2, wherein said illumination means comprises at least one flourescent light emitting element.

9. An illuminated tool tray apparatus according to claim 1, further comprising a switching mechanism and wherein said illumination means includes at least one white colored light emitting element and at least one amber colored light emitting element wherein said switching mechanism selectively controls said illumination means to emit white colored light, amber colored light, and both white and amber colored light.

10. An illuminated tool tray apparatus according to claim 2, further comprising a switching mechanism and wherein said illumination means includes at least one white colored light emitting element and at least one amber colored light emitting element wherein said switching mechanism selectively controls said illumination means to emit white colored light, amber colored light, and both white and amber colored light.

11. An illuminated tool tray apparatus according to claim 3, further comprising a switching mechanism and wherein said illumination means includes at least one white colored light emitting element, and at least one amber colored light emitting element wherein said switching mechanism selectively controls said illumination means to emit white colored light, amber colored light, and both white and amber colored light.

12. An illuminated tool tray apparatus according to claim 4, further comprising a switching mechanism and wherein said illumination means includes at least one white colored light emitting element, and at least one amber colored light emitting element wherein said switching mechanism selectively controls said illumination means to emit white colored light, amber colored light, and both white and amber colored light.

13. An illuminated tool tray apparatus according to claim 1, further comprising a dimmer switching mechanism to selectively control said illumination means to emit a variable amount of light.

14. An illuminated tool tray apparatus according to claim 2, further comprising a dimmer switching mechanism to selectively control said illumination means to emit a variable amount of light.

15. An illuminated tool tray apparatus according to claim 3, further comprising a dimmer switching mechanism to selectively control said illumination means to emit a variable amount of light.

16. An illuminated tool tray apparatus according to claim 4, further comprising a dimmer switching mechanism to selectively control said illumination means to emit a variable amount of light.

17. An illuminated tool tray apparatus according to claim 9, further comprising a dimmer switching mechanism to selectively control said illumination means to emit a variable amount of light.

18. An illuminated tool tray apparatus according to claim 10, further comprising a dimmer switching mechanism to selectively control said illumination means to emit a variable amount of light.

19. An illuminated tool tray apparatus according to claim 11, further comprising a dimmer switching mechanism to selectively control said illumination means to emit a variable amount of light.

20. An illuminated tool tray apparatus according to claim 12, further comprising a dimmer switching mechanism to selectively control said illumination means to emit a variable amount of light.

* * * * *

UNITED STATES PATENT AND TRADEMARK OFFICE

CERTIFICATE OF CORRECTION

PATENT NO. : 6,076,937
DATED : June 20, 2000
INVENTOR(S) : Keith Bernard Wood, et al.

It is certified that error appears in the above-identified patent and that said Letters Patent is hereby corrected as shown below:

Claims,

Please replace Claims 1-20 with Claims 1-9 as shown.

-- 1. An illuminated tool tray apparatus comprising:
a tool tray having an interior sidewall surface with an upper peripheral edge portion and an interior tool storage area;
a power supply; and an illumination mechanism connected to said power supply and disposed on at least a part of said sidewall surface and at least partly below the upper peripheral edge portion, wherein said illumination mechanism emits light to illuminate said interior tool storage area and an area surrounding said tool tray.

2. An illuminated tool trap apparatus according to claim 1, wherein said illumination mechanism is disposed around said upper peripheral edge portion of said interior sidewall surface.

3. An illuminated tool tray apparatus according to claim 1, wherein said illumination mechanism comprises at least one strip of light disbursing polymer material having at least one light emitting element embedded therein.

4. An illuminated tool tray apparatus according to claim 1, wherein said illumination mechanism comprises at least one incandescent light emitting element.

5. An illuminated tool tray apparatus according to claim 1, wherein said illumination means comprises at least one flourescent light emitting element.

UNITED STATES PATENT AND TRADEMARK OFFICE

CERTIFICATE OF CORRECTION

] PATENT NO. : 6,076,937
] DATED : June 20, 2000
] INVENTOR(S) : Keith Bernard Wood, et al.

It is certified that error appears in the above-identified patent and that said Letters Patent is hereby corrected as shown below:

6. An illuminated tool tray apparatus according to claim 1, further comprising:
   a switching mechanism, wherein said illumination mechanism includes at least one white colored light emitting element and at least one amber colored light emitting element, and wherein said switching mechanism selectively controls said illumination mechanism to emit white colored light, amber colored light, and both white and amber colored light.

7. An illuminated tool tray apparatus according to claim 1, further comprising a dimmer switching mechanism to selectively control said illumination mechanism to emit a variable amount of light.

8. An illuminated tool tray apparatus comprising:
   a tool tray having an interior sidewall surface with an upper peripheral edge portion and an interior tool storage area;
   a power supply; and an illumination mechanism connected to said power supply and disposed on at least a part of said sidewall surface, wherein said illumination mechanism emits light to illuminate said interior tool storage area and an area surrounding said tool tray, and wherein said illumination mechanism comprises at least one strip of light disbursing polymer material having at least one light emitting element embedded therein.

9. An illumination tool tray apparatus comprising:
   a tool tray having an interior sidewall surface with an upper peripheral edge portion and an interior tool storage area;
   a power supply;
   a switching mechanism; and

UNITED STATES PATENT AND TRADEMARK OFFICE

CERTIFICATE OF CORRECTION

] PATENT NO. : 6,076,937
] DATED : June 20, 2000
] INVENTOR(S) : Keith Bernard Wood, et al.

It is certified that error appears in the above-identified patent and that said Letters Patent is hereby corrected as shown below:

illumination mechanism connected to said power supply and disposed on at least a part of said sidewall surface, wherein said illumination mechanism emits light to illuminate said interior tool storage area and an area surrounding said tool tray, and wherein said illumination mechanism includes at least one white colored light emitting element and at least one amber colored light emitting element, and wherein said switching mechanism selectively controls said illumination mechanism to emit white colored light, amber colored light, and both white and amber colored light. --

Signed and Sealed this

Thirteenth Day of November, 2001

*Attest:*

Nicholas P. Godici

NICHOLAS P. GODICI

*Attesting Officer*

*Acting Director of the United States Patent and Trademark Office*